US007973613B2

(12) United States Patent
Chang et al.

(10) Patent No.: US 7,973,613 B2
(45) Date of Patent: Jul. 5, 2011

(54) MODE CONVERTER AND MICROWAVE ROTARY JOINT WITH THE MODE CONVERTER

(75) Inventors: Tsun-Hsu Chang, Hsinchu (TW); Bo-Ren Yu, Hsinchu (TW)

(73) Assignee: National Tsing Hua University, Hsinchu (TW)

( * ) Notice: Subject to any disclaimer, the term of this patent is extended or adjusted under 35 U.S.C. 154(b) by 186 days.

(21) Appl. No.: 12/468,332

(22) Filed: May 19, 2009

(65) Prior Publication Data

US 2010/0123529 A1 May 20, 2010

(30) Foreign Application Priority Data

Nov. 20, 2008 (TW) ..... 97144842 A

(51) Int. Cl.
*H01P 5/12* (2006.01)
*H01P 1/06* (2006.01)

(52) U.S. Cl. ..... 333/21 R; 333/261; 333/125

(58) Field of Classification Search ..... 333/21 R, 333/21 A, 121, 122, 125, 117, 256, 257, 261
See application file for complete search history.

(56) References Cited

U.S. PATENT DOCUMENTS 5,442,329 A * 8/1995 Ghosh et al. ..... 333/21 R
7,408,427 B1 * 8/2008 Lee-Yow et al. ..... 333/126
2007/0182507 A1 * 8/2007 Chang et al. ..... 333/125

* cited by examiner

*Primary Examiner* — Stephen E Jones
(74) *Attorney, Agent, or Firm* — Roger H. Chu

(57) ABSTRACT

A microwave rotary joint comprises a mode converter for converting microwave signals of a $TE_{01}$ circular symmetric mode, and the mode converter comprises: two circular waveguides, one end of each of the waveguides has a circular input/output port; and two power dividing structures, each of the power dividing structure has an input/output port and four connecting ports, the four connecting ports are separated and surround each of the circular waveguides and connected to the inside of each of the circular waveguides, the two circular waveguides are integrated as one member through rotating a bearing.

20 Claims, 5 Drawing Sheets

MODE CONVERTER AND MICROWAVE ROTARY JOINT WITH THE MODE CONVERTER

CROSS-REFERENCE TO RELATED APPLICATION

This application claims foreign priority from a Taiwan Patent Application, Ser. No. 097144842, filed on Nov. 20, 2008.

BACKGROUND OF THE INVENTION

1. Field of the Invention

The present invention generally relates to a mode converter and a microwave rotary joint with the mode converter, more particularly to a mode converter that converts microwave signals of a $TE_{01}$ circular symmetric mode and a microwave rotary joint that transmits the microwave signals of the $TE_{01}$ mode.

2. Description of the Prior Art

High frequency microwave rotary joints are mainly applied to radar systems or terminal joints of cables, and therefore the microwave rotary joints are important waveguide structures. Hence, to design a high frequency microwave rotary joint shall think about a propagation efficiency and a suitable band scope, and it is more important that the rotary joint must be with a propagation characteristic not related to swirl.

With reference to FIG. 1, which illustrates a schematic view of a typical microwave rotary joint. As shown in the figure, the microwave rotary joint 100 includes a fastening end 120, a swirl end 140, a middle channel 160, and two mode converters 180, wherein the dimensions and shapes of the fastening end 120 and the swirl end 140 are determined by a system, which is connected to the fastening end 120 and the swirl end 140, usually the fastening end 120 and the swirl end 140 are rectangular waveguides, two ends of the middle channel 160 are respectively connected to the fastening end 120 and the swirl end 140 and shaped as circular, a swirl structure of the microwave rotary joint 100 is disposed at the middle channel 160.

As aforesaid, the structures of the fastening end 120, the swirl end 140 and the middle channel 160 are different. For this reason, the operation modes to the fastening end 120, the swirl end 140 and the middle channel 160 are different; consequently the two mode converters 180 must be respectively disposed at two positions, one of which is between the fastening end 120 and the middle channel 160, the other one is between the swirl end 140 and the middle channel 160, so as to proceed conversion of waves for a better couple effect. Further that, the conversion types of the mode converter 180 are determined by the modes of microwaves, and the microwaves are transmitted by the microwave rotary joint 100.

To decide the operation mode of the middle channel 160 is the most important. To begin with, the transmitting modes of microwaves inside the middle channel 160 must be circular and symmetric and without the influence of the swirl, for examples, circular $TE_{01}$ mode, circular $TE_{11}$ mode, etc. The next, the swirl structure of the microwave rotary joint 100 is disposed at the middle channel 160, and a seam must be at where the swirl structure is. For those transmitting modes suitable to the middle channel 160, the circular $TE_{01}$ is only with traverse surface currents and not without vertical surface currents, which is along the axial direction of the column middle channel 160, the surface currents may not be easily cut off by the seam. Accordingly the circular $TE_{01}$ mode is acknowledged to be a preferred choice to the microwave rotary joint.

Thereafter, to effectively convert the microwave signals from the swirl end 120 or the fastening end 140 to the microwaves with the circular $TE_{01}$ mode and transmitted in the middle channel 160 becomes an important issue for people skilled in the art.

SUMMARY OF THE INVENTION

The primary objective of the present invention is to provide a mode converter and a microwave rotary joint with the mode converter to effectively convert microwaves with a rectangular mode to microwaves with a circular mode in order to change the propagation direction thereof, wherein the microwaves with the circular mode may not be affected by swirl.

The secondary objective of the present invention is to provide the mode converter and the microwave rotary joint with the mode converter to avoid that the transmitting effect of microwaves is affected by a seam of a swirl structure.

The present invention provides a microwave rotary joint having a mode converter for converting microwave signals of a $TE_{01}$ circular symmetric mode, and the mode converter comprises: two circular waveguides, one end of each of the waveguides has a circular input/output port; and two power dividing structures, each of the power dividing structure has an input/output port and four connecting ports, the four connecting ports are separated and surround each of the circular waveguides and connected to the inside of each of the circular waveguides, the two circular waveguides are integrated as one member through rotating a bearing.

As aforesaid, the present invention provides the microwave rotary joint to transmit the microwave signals of the $TE_{01}$ circular symmetric mode, and the microwave rotary joint comprises: a rotational portion having a first circular waveguide, which one end has a first circular input/output port; and a first power dividing structure, which is disposed on the first circular waveguide and has a first rectangular input/output port and four first connecting ports, the first rectangular input/output port being about equidistant to each of the four first connecting ports, the four first connecting ports surrounding the first circular waveguide and an interval with 90 degrees being between every two neighbor first connecting ports, the four first connecting ports connecting to the inside of the first circular waveguide; and a fastening portion having a second circular waveguide being rotatable to connect to the first circular waveguide, one end of the second circular waveguide having a second circular input/output port, which is connected to the first circular input/output port, the first circular waveguide being coaxial to the second circular waveguide; and a second power dividing structure, which is disposed on the second circular waveguide and has a second rectangular input/output port and four second connecting ports, the second rectangular input/output port being about equidistant to each of the four second connecting ports, the four second connecting ports surrounding the second circular waveguide and an interval with 90 degrees being between every two neighbor second connecting ports, the four second connecting ports connecting to the inside of the second circular waveguide; wherein the rotational portion and the fastening portion are integrated as one member through a bearing.

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Following preferred embodiments and figures will be described in detail so as to achieve aforesaid object.

Figure 1:
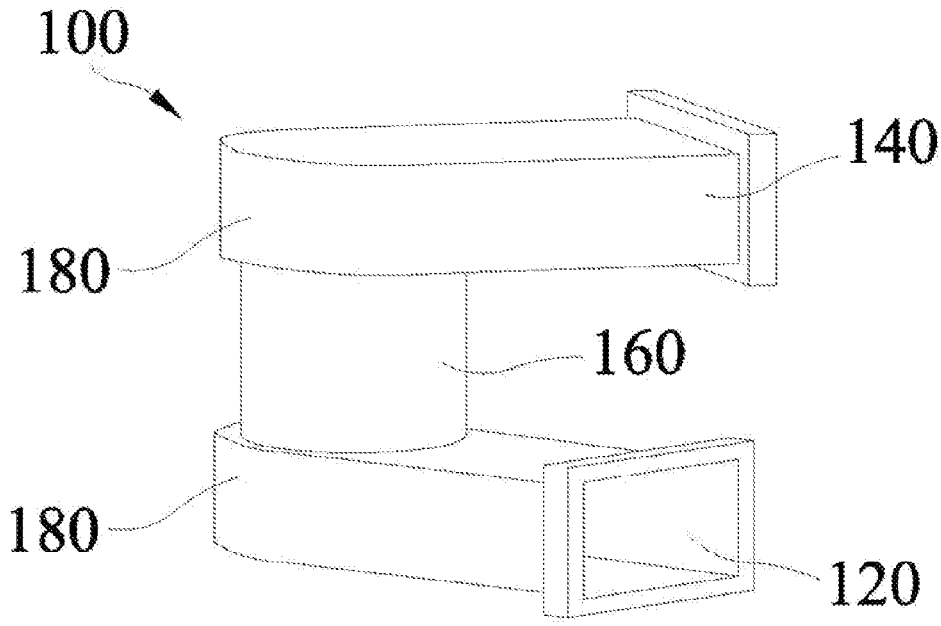
Fig. 1 (PRIOR ART)
FIG. 1 illustrates a schematic view of a typical microwave rotary joint.
Figure 2:
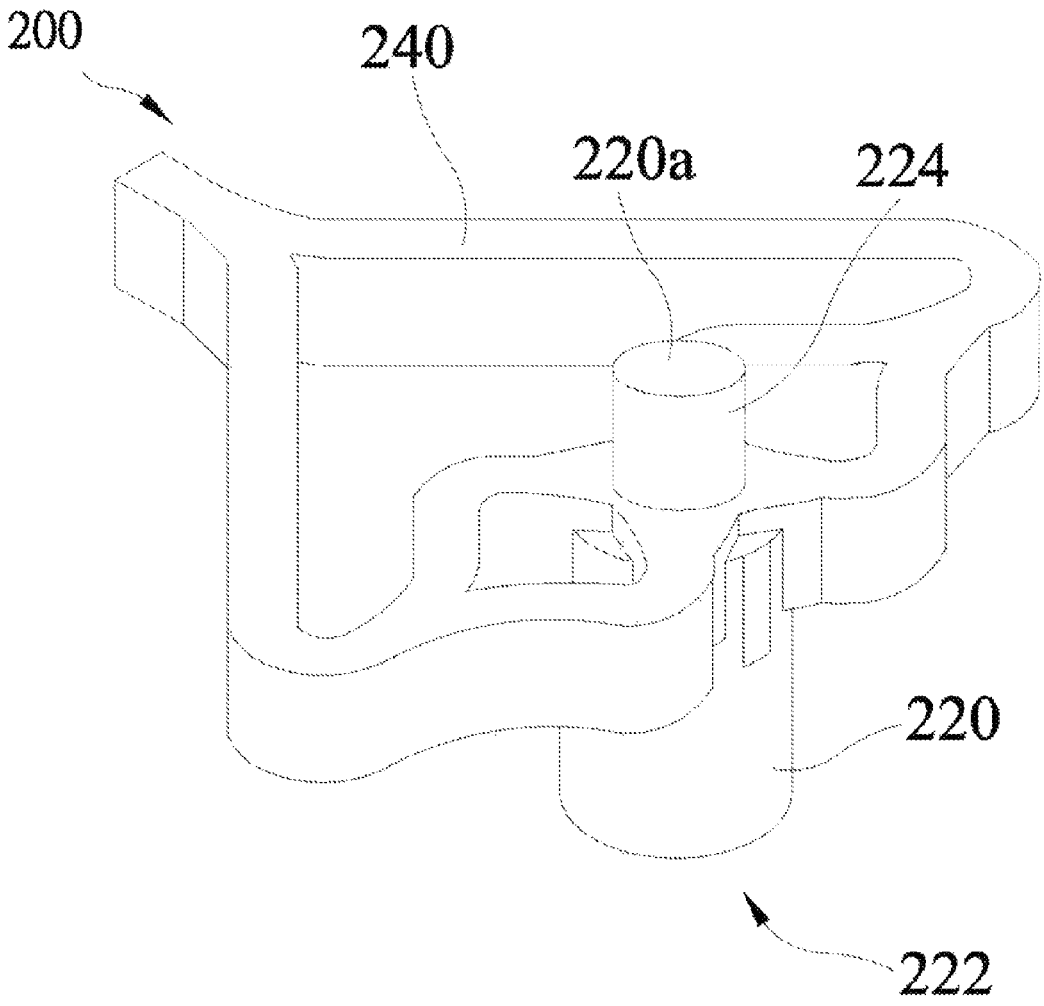
FIG. 2 illustrates a schematic view of a preferred embodiment of a mode converter of the present invention.
Figure 2A:
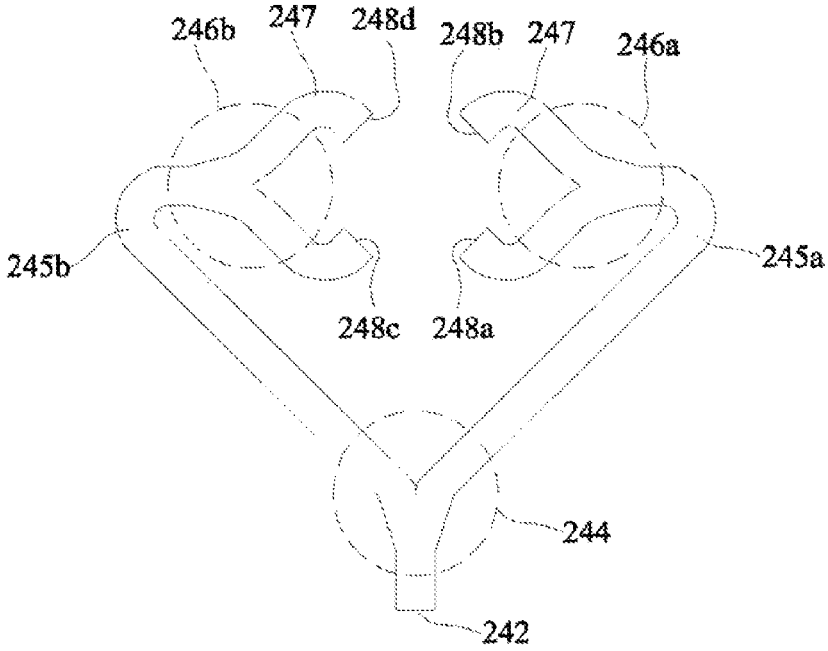
FIG. 2A illustrates a schematic top view of a power dividing structure of FIG. 2.

With references to FIG. 2 and FIG. 2A, which are a schematic view of a preferred embodiment of a mode converter 200 of the present invention and a schematic top view of a power dividing structure 240 of FIG. 2. The mode converter 200 is to convert microwave signals with a rectangular $TE_{01}$ mode to microwave signals with a circular symmetric $TE_{01}$ mode or vice versa. Following is an example of converting the rectangular mode to the circular symmetric mode. As shown in figures, the mode converter 200 includes a circular waveguide 220 and a power dividing structure 240. One end of the circular waveguide 220 has a circular input/output port 222. The power dividing structure 240 is a rectangular tube and has a rectangular input/output port 242 and four connecting ports 248*a*, 248*b*, 248*c*, and 248*d*. The rectangular input/output port 242 is about equidistant to each of the four connecting ports 248*a*, 248*b*, 248*c*, and 248*d*, the four connecting ports 248*a*, 248*b*, 248*c*, and 248*d* surround the circular waveguide 220 and an interval with 90 degrees being between every two neighbor connecting ports, the four connecting ports 248*a*, 248*b*, 248*c*, and 248*d* are connected to the inside of the circular waveguide 220. The dimensions of the channel of the power dividing structure 240 are based on a band. Generally speaking, the rectangular waveguide with the dimensions of 0.28 in.×0.14 in. can be a material for the power dividing structure 240 if an operation is in Ka-band. While two mode converters 200 are integrated as one member via a bearing (not shown in figures), the two mode converters 200 can be changed for their positions through rotation. Due to that the mode converter 200 is to convert the microwave signals with the $TE_{01}$ mode, the characteristic of rotation without change is existed while in conversion.

With reference to FIG. 2A, each power dividing structure 240 has a first Y-type waveguide 244, a second Y-type waveguide 246*a* and a third Y-type waveguide 246*b*, one end of the first Y-type waveguide 244 is connected to the rectangular input/output port 242, other two ends of the first Y-type waveguide 244 are connected to the second Y-type waveguide 246*a* and the third Y-type waveguide 246*b* respectively in order to averagely transmit signals from the rectangular input/output port 242 to the second Y-type waveguide 246*a* and the third Y-type waveguide 246*b*. The second Y-type waveguide 246*a* is connected to the first Y-type waveguide 244 and the two connecting ports 248*a* and 248*b* so as to averagely transmit signals from the first Y-type waveguide 244 to the two connecting ports 248*a* and 248*b*. The third Y-type waveguide 246*b* is connected to the first Y-type waveguide 244 and the other two connecting ports 248*c* and 248*d* in order to averagely transmit signals from the first Y-type waveguide 244 to the two connecting ports 248*c* and 248*d*. The microwave signals from the rectangular input/output port 242 are divided into two parts by the first Y-type waveguide 244, and the two parts of the microwave signals are respectively transmitted to the second Y-type waveguide 246*a* and the third Y-type waveguide 246*b*, then to the four connecting pots 248*a*, 248*b*, 248*c*, and 248*d* through the second Y-type waveguide 246*a* and the third Y-type waveguide 246*b*.

Figure 3:
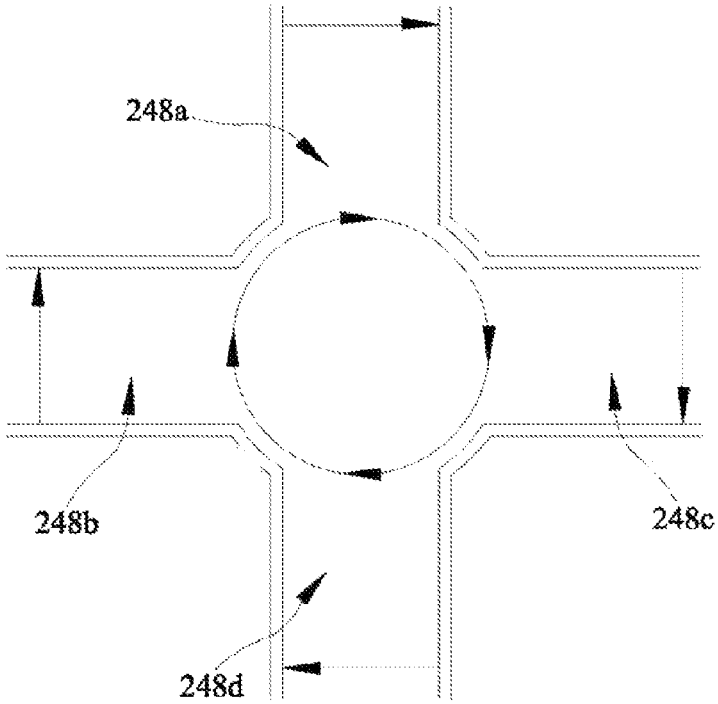
FIG. 3 illustrates a schematic view of the mode converter activating a $TE_{01}$ circular symmetric mode through a $TE_{01}$ rectangular mode of the present invention.

It is to be noted that the distances between the rectangular input/output port 242 and the four connecting ports 248*a*, 248*b*, 248*c*, and 248*d* are about equal. As shown in FIG. 3, the phases and amplitudes of the microwave signals from the four connecting ports 248*a*, 248*b*, 248*c*, and 248*d* to the circular waveguide 220 are about equal. Due to that the four rectangular connecting ports 248*a*, 248*b*, 248*c*, and 248*d* surround the circular waveguide 220 and an interval with 90 degrees is between every two neighbor connecting ports, each polarization direction of signals from the four connecting ports 248*a*, 248*b*, 248*c*, and 248*d* to the circular waveguide 220 has an angle of 90 degrees. The polarization directions are either clockwise or counter clockwise. The four connecting ports 248*a*, 248*b*, 248*c*, and 248*d* can then be activated beside the circular waveguide 220 in order to gain the circular $TE_{01}$ mode signal with high degree of purity.

As shown in FIG. 2A, to ensure that the distances between the rectangular input/output port 242 and the four connecting ports 248*a*, 248*b*, 248*c*, and 248*d* are respectively equal, the power dividing structure 240 is symmetric according to the first Y-type waveguide 244, that is, the second Y-type waveguide 246*a* and the third Y-type waveguide 246*b* are symmetric to the first Y-type waveguide 244. As a preferred embodiment shown in FIG. 2A, an angle between microwave signals input to the first Y-type waveguide 244 and microwave signals output from the first Y-type waveguide 244 is around 45 degrees. Microwave signals output from the first Y-type waveguide 244 are transmitted to the second Y-type waveguide 246*a* via a first bending waveguide 245*a*, and microwave signals output from the first Y-type waveguide 244 are transmitted to the third Y-type waveguide 246*b* through another first bending waveguide 245*b*. The bending angles of the two first bending waveguides 245*a* and 245*b* are about 135 degrees, but the directions of the bending angles are opposite.

With references to FIG. 2 and FIG. 2A, the second Y-type waveguide 246*a* and the third Y-type waveguide 246*b* are disposed on a side opposite to a side with the circular waveguides 220, and the transmitting direction of the microwave signals inbound to the second Y-type waveguide 246*b* is about parallel to the transmitting direction of the microwave signals inbound to the third Y-type waveguide 246*b*, further that, the two directions are opposite to each other. The two connecting ports 248*a* and 248*b* corresponding to the second Y-type waveguide 246*a* are disposed on a side where the circular waveguide 220 is close to the second Y-type waveguide 246*a*. The two connecting ports 248*c* and 248*d* corresponding to the third Y-type waveguide 246*b* are disposed on a side where the circular waveguide 220 is close to the third Y-type waveguide 246*b*.

Besides, as shown in FIG. 2A, an angle between microwave signals from the first Y-type waveguide 244 to the second Y-type waveguide 246*a* and microwave signals from the second Y-type waveguide 246*a* to the two connecting ports 248*a* and 248*b* is about 45 degrees. Microwave signals output from the second Y-type waveguide 246*a* are transmitted to the two corresponding connecting ports 248*a* and 248*b* through the two bending waveguides 247, and the bending angles of the two second bending waveguides 247 are greater than 90 degrees.

Figure 4:
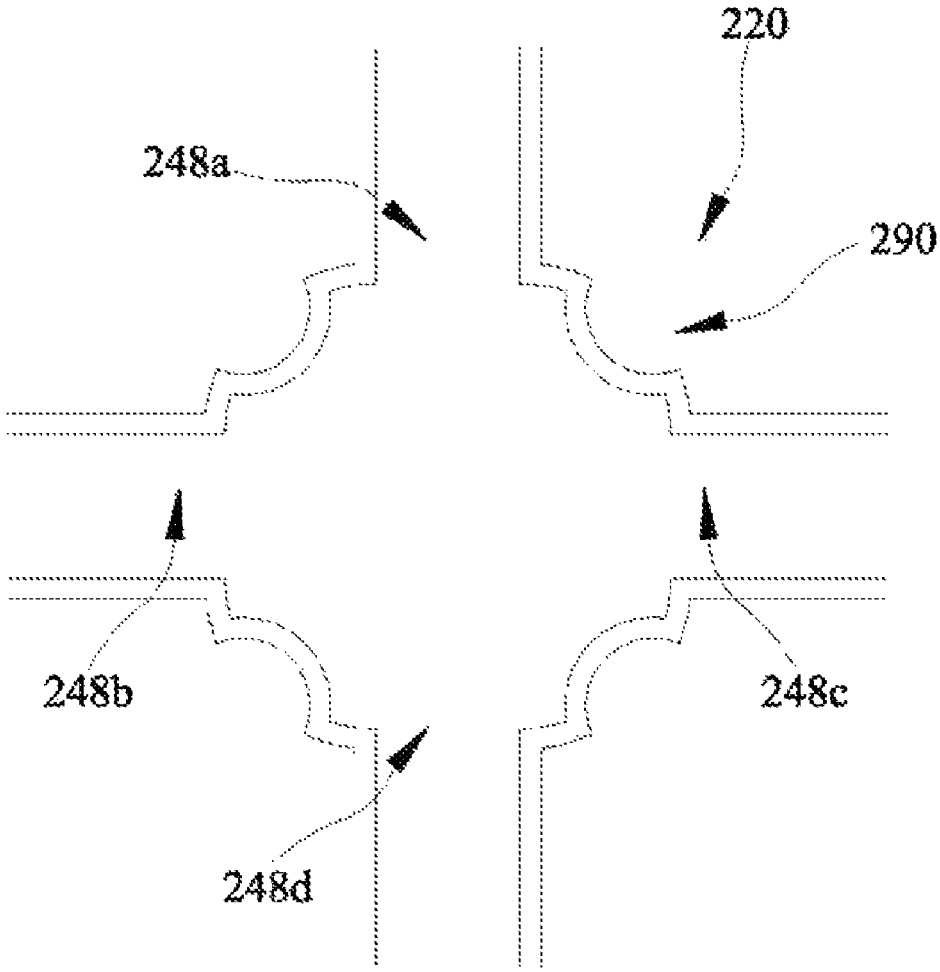
FIG. 4 illustrates a schematic view of another preferred embodiment of the mode converter of the present invention.

The end of the circular waveguide 220 away from the end of the circular input/output port 222 is a close end 220*a* in order to let microwave signals be output only from the circular input/output port 222. As a preferred embodiment in FIG. 2, the end of the circular waveguide 220 far away from the circular input/output port 222 is connected to the circular waveguide 224 with a higher cut-off frequency and a smaller diameter in order to construct a short-circuit end. Such that, the circular waveguide 224 with the higher cut-off frequency not only restrict that the microwave signals are output from the circular input/output port 222 but also adjust the impedance of the mode converter 200 in order to gain better couple effects of incidence waves. Besides, as shown in FIG. 4, to promote the purity of the circular $TE_{01}$ mode activated in the circular waveguide 220, another preferred embodiment of the present invention is as following. That is, each two neighbor connecting ports of the four connecting portions 248*a*, 248*b*, 248*c*, and 248*d* has a semicircle groove 290, which is indented toward the inside of the circular waveguide 220.

Figure 5:
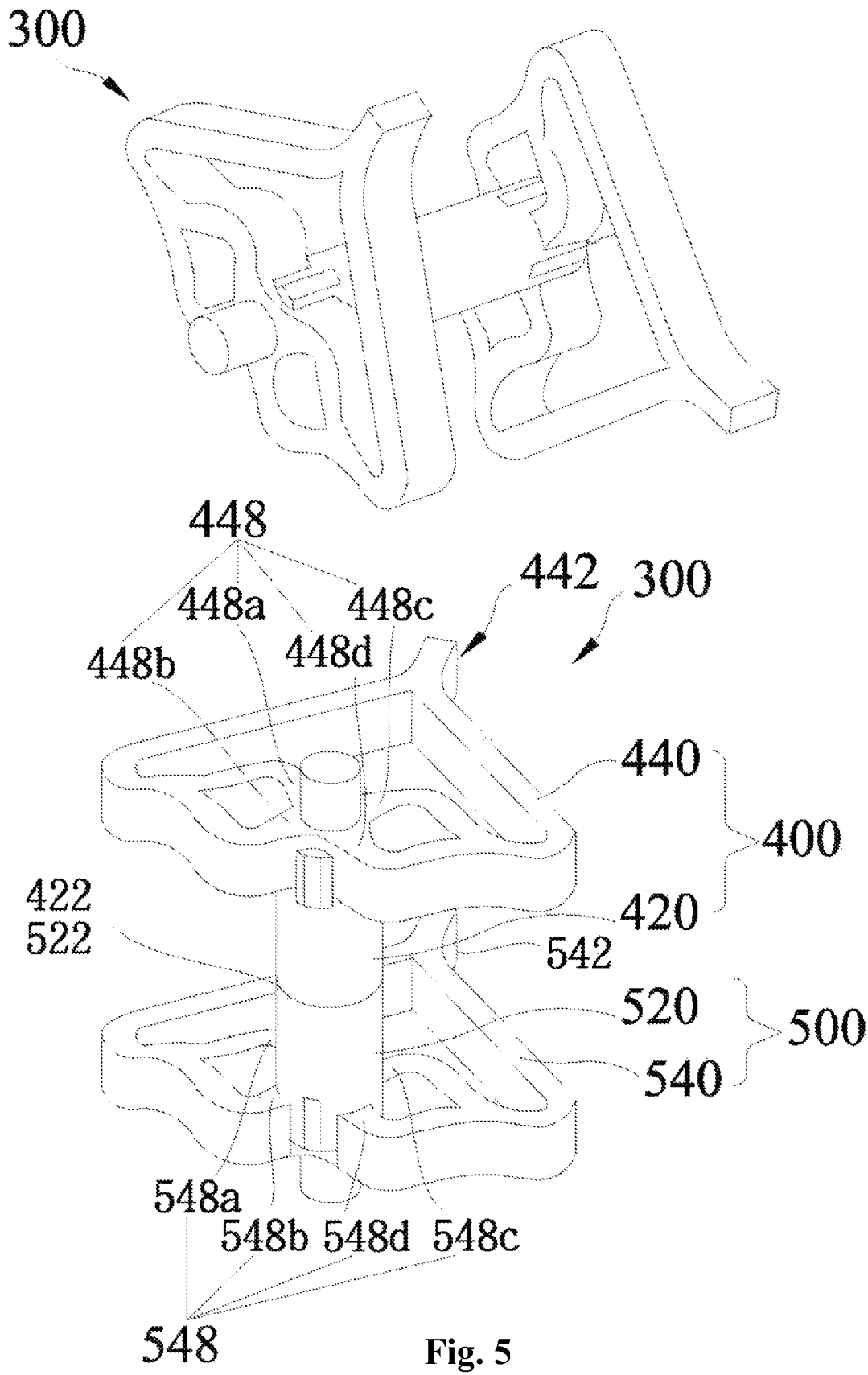
FIG. 5 illustrates a schematic view of a preferred embodiment of a microwave rotary joint of the present invention.

With reference to FIG. 5, which illustrates a schematic view of a preferred embodiment of a microwave rotary joint 300 of the present invention. The microwave rotary joint 300 mainly transmits microwave signals of the $TE_{01}$ mode and comprises a rotational portion 400 and a fastening portion 500, wherein the rotational portion 400 includes a first circular waveguide 420 and a first power dividing structure 440, one end of the first circular waveguide 420 has a first circular input/output port 422, the first power dividing structure 400 is a rectangular tube and disposed on the first circular waveguide 420, more, the first power dividing structure 440 has a first rectangular input/output port 442 and four first connecting ports 448*a*, 448*b*, 448*c*, and 448*d*, the first rectangular input/output port 442 is about equidistant to each of the four first connecting ports 448*a*, 448*b*, 448*c*, and 448*d*, the four first connecting ports 448*a*, 448*b*, 448*c*, and 448*d* surround the first circular waveguide 420 and an interval with 90 degrees is between every two neighbor first connecting ports, the four first connecting ports 448*a*, 448*b*, 448*c*, and 448*d* are connected to the inside of the first circular waveguide 420, the rotational portion 400 and the fastening portion 500 are integrated as one member through a bearing.

The fastening portion 500 includes a second circular waveguide 520 and a second power dividing structure 540, the second circular waveguide 520 is rotatable to connect to the first circular waveguide 420, one end of the second circular waveguide 520 has a second circular input/output port 522, which is connected to the first circular input/output port 422, the first circular waveguide 420 is coaxial to the second circular waveguide 520; and a second power dividing structure 540 is a rectangular tube and disposed on the second circular waveguide 520 and has a second rectangular input/output port 542 and four second connecting ports 548*a*, 548*b*, 548*c*, and 548*d*, the second rectangular input/output port 542 is about equidistant to each of the four second connecting ports 548*a*, 548*b*, 548*c*, and 548*d*, the four second connecting ports 548*a*, 548*b*, 548*c*, and 548*d* surround the second circular waveguide 520 and an interval with 90 degrees is between every two neighbor second connecting ports, the four second connecting ports 548*a*, 548*b*, 548*c*, and 548*d* are connected to the inside of the second circular waveguide 520. Such that, microwave signals are transmitted between the first rectangular input/output port 442 and the second rectangular input/output port 542.

As shown in FIG. 5, a bearing (not shown in the figure) is disposed between the first circular waveguide 420 and the second circular waveguide 520 in order to rotate the first circular waveguide 420 to connect to the second circular waveguide 520. To avoid the consumption of transmitting power from the first circular waveguide 420 to the second circular waveguide 520, the diameters of the first circular waveguide 420 and the second circular waveguide 520 are preferably the same.

As a conclusion, the mode converter 200 and the microwave rotary joint 300 is able to effectively convert the rectangular $TE_{01}$ mode to the circular $TE_{01}$ mode. Such that, the characteristics of the microwave signals of the circular $TE_{01}$ mode can be completely used in the microwave rotary joint 300. That is, the circular $TE_{01}$ is only with traverse surface currents and without vertical surface currents, which is along the central channel of the circular column. Hence a condition that the signal transmission is affected by the seam of the bearing of the microwave rotary joint 300 can be avoided, and the influence of the swirl angle of the microwave rotary joint 300 to the transmitting efficiency is excluded as well.

What is claimed is:

1. A mode converter for converting microwave signals of a $TE_{01}$ circular symmetric mode comprising:

two circular to circular waveguides, one end of each of the waveguides having a circular input/output port; and two power dividing structures, each of the power dividing structures having an input/output port and four connecting ports, the four connecting ports being separated and surrounding said each of the circular to circular waveguides and connecting to the inside of said each of the circular to circular waveguides, the two circular to circular waveguides being integrated as one member through rotating a bearing; wherein said each of the circular waveguides has at least one semicircle groove adjacent to two of the four connecting ports.

2. The mode converter for converting the microwave signals of the $TE_{01}$ circular symmetric mode as cited in claim 1, wherein the input/output port on the end of each of the circular waveguide is circular.

3. The mode converter for converting the microwave signals of the $TE_{01}$ circular symmetric mode as cited in claim 1, wherein the power dividing structures are rectangular, the input/output ports and the four connecting ports are rectangular.

4. The mode converter for converting the microwave signals of the $TE_{01}$ circular symmetric mode as cited in claim 1, wherein the end of the circular waveguide away from the end of the circular input/output port is a cut-off end.

5. The mode converter for converting the microwave signals of the $TE_{01}$ circular symmetric mode as cited in claim 4, wherein the cut-off end is connected to a circular waveguide with a higher cut-off frequency.

6. The mode converter for converting the microwave signals of the $TE_{01}$ circular symmetric mode as cited in claim 1, wherein each power dividing structure has a first Y-type waveguide, a second Y-type waveguide and a third Y-type waveguide, the first Y-type waveguide being connected to the rectangular input/output port, the second Y-type waveguide being connected to the first Y-type waveguide and the two connecting ports, the third Y-type waveguide being connected to the first Y-type waveguide and the other two connecting ports, the microwave signals from the rectangular input/output port being divided into two parts by the first Y-type waveguide, the two parts of the microwave signals being respectively transmitted to the second Y-type waveguide and the third Y-type waveguide, then to the four connecting ports through the second Y-type waveguide and the third Y-type waveguide.

7. The mode converter for converting the microwave signals of the $TE_{01}$, circular symmetric mode as cited in claim 6, wherein the power dividing structure is symmetric according to the first Y-type waveguide.

8. The mode converter for converting the microwave signals of the $TE_{01}$ circular symmetric mode as cited in claim 6, wherein the transmitting direction of the microwave signals inbound to the second Y-type waveguide is about parallel to the transmitting direction of the microwave signals inbound to the third Y-type waveguide.

9. The mode converter for converting the microwave signals of the $TE_{01}$ circular symmetric mode as cited in claim 6, wherein the second Y-type waveguide and the third Y-type waveguide are disposed on a side opposite to a side with the circular waveguides and the two connecting ports corresponding to the second Y-type waveguide and the other two connecting ports corresponding to the third Y-type waveguide are disposed on a side opposite to the side with the circular waveguides.

10. A microwave rotary joint, which transmits microwave signals of a $TE_{01}$ mode, comprising:

a rotational portion comprising:

a first circular waveguide, which one end has a first circular input/output port; and a first power dividing structure, which is disposed on the first circular waveguide and has a first rectangular input/output port and four first connecting ports, the first rectangular input/output port being about equidistant to each of the four first connecting ports, the four first connecting ports surrounding the first circular waveguide and an interval with 90 degrees being between every two neighbor first connecting ports, the four first connecting ports connecting to the inside of the first circular waveguide; and a fastening portion comprising:

a second circular waveguide being rotatable to connect to the first circular waveguide, one end of the second circular waveguide having a second circular input/output port, which is connected to the first circular input/output port, the first circular waveguide being coaxial to the second circular waveguide; and a second power dividing structure, which is disposed on the second circular waveguide and has a second rectangular input/output port and four second connecting ports, the second rectangular input/output port being about equidistant to each of the four second connecting ports, the four second connecting ports surrounding the second circular waveguide and an interval with 90 degrees being between every two neighbor second connecting ports, the four second connecting ports connecting to the inside of the second circular waveguide;

wherein the rotational portion and the fastening portion are integrated as one member through a bearing, and wherein the first circular waveguide has at least one semicircle groove adjacent to two neighbors of the four first connecting ports and the second circular waveguide has at least one semicircle groove adjacent to two neighbors of the four second connecting ports.

11. The microwave rotary joint according to claim 10, wherein the end of the first circular waveguide away from the end of the first circular input/output port is a first cut-off end, the end of the second circular waveguide away from the end of the second circular input/output port is a second cut-off end.

12. The microwave rotary joint according to claim 10, wherein the first circular waveguide is connected to the second circular waveguide through a bearing.

13. The microwave rotary joint according to claim 10, wherein the diameter of the first circular waveguide is the same as the diameter of the second circular waveguide.

14. The microwave rotary joint according to claim 10, wherein the first power dividing structure has a first Y-type waveguide, a second Y-type waveguide and a third Y-type waveguide, the first Y-type waveguide being connected to the first rectangular input/output port, the second Y-type waveguide being connected to the first Y-type waveguide and the two first connecting ports, the third Y-type waveguide being connected to the first Y-type waveguide and the other two first connecting ports, the microwave signals from the rectangular input/output port being divided into two parts by the first Y-type waveguide, the two parts of the microwave signals being respectively transmitted to the second Y-type waveguide and the third Y-type waveguide, then to the four connecting ports through the second Y-type waveguide and the third Y-type waveguide.

15. The microwave rotary joint according to claim 14, wherein the first power dividing structure is symmetric according to the first Y-type waveguide.

16. The microwave rotary joint according to claim 14, wherein the first power dividing structure is the same as the second dividing structure.

17. The microwave rotary joint according to claim 14, wherein the transmitting direction of the microwave signals inbound to the first Y-type waveguide is about 45 degrees to the transmitting direction of the microwave signals outbound from the first Y-type waveguide, the microwave signals output from the first Y-type waveguide being transmitted to the second Y-type waveguide through a first bending waveguide, the bending angle of the first bending waveguide is about 135 degrees.

18. The microwave rotary joint according to claim 14, wherein the transmitting direction of the microwave signals inbound to the second Y-type waveguide is about parallel to the transmitting direction of the microwave signals inbound to the third Y-type waveguide.

19. The microwave rotary joint according to claim 14, wherein the transmitting direction of the microwave signals inbound to the second Y-type waveguide is about 45 degrees to the transmitting direction of the microwave signals outbound from the second Y-type waveguide, the microwave signals output from the second Y-type waveguide being transmitted to the corresponding first connecting port through a second bending waveguide, the bending angle of the second bending waveguide is about 90 degrees.

20. The microwave rotary joint according to claim 14, wherein the second Y-type waveguide and the third Y-type waveguide are disposed on a side opposite to a side with the first circular waveguides and the two first connecting ports corresponding to the second Y-type waveguide and the other two first connecting ports corresponding to the third Y-type waveguide are disposed on a side opposite to the side with the first circular waveguides.

* * * * *